US005720268A

United States Patent [19]

Koltze

[11] Patent Number: 5,720,268

[45] Date of Patent: Feb. 24, 1998

[54] MECHANICAL ACCELERATING DEVICE FOR PROJECTILES

[76] Inventor: Rüdiger Koltze, Rote Str. 29, D-37073 Göttingen, Germany

[21] Appl. No.: 652,817

[22] Filed: May 23, 1996

[30] Foreign Application Priority Data

May 27, 1995 [DE] Germany ..... 195 19 564.7

[51] Int. Cl.[6] ..... F41B 5/00; F41B 5/12

[52] U.S. Cl. ..... 124/25; 124/23.1

[58] Field of Search ..... 124/23.1, 24.1, 124/25.6, 86, 88, 25

[56] References Cited

U.S. PATENT DOCUMENTS

| | | | |
|---|---|---|---|
| D. 237,490 | 11/1975 | McArdle | 124/23.1 X |
| 1,932,195 | 10/1933 | Stroup | 124/23.1 X |
| 3,552,373 | 1/1971 | VanHecke | 124/23.1 |
| 4,651,707 | 3/1987 | Bozek | 124/23.1 X |
| 4,955,354 | 9/1990 | Bozek | 124/23.1 |

FOREIGN PATENT DOCUMENTS

| | | |
|---|---|---|
| 0 029 866 | 5/1981 | European Pat. Off. . |
| 42 20 575 | 8/1993 | Germany . |

*Primary Examiner*—John A. Ricci
*Attorney, Agent, or Firm*—Thomas, Kayden, Horstemeyer & Risley

[57] ABSTRACT

A mechanical accelerating device (1) for projectiles, especially for arrows and bolts, has a bow holder, at least two elastic bows (2) attached to the bow holder, each of the bows (2) being engaged by a bow string (3), and at least one additional string (4) connecting the bow strings, the force of the bows acting on the actual projectile by the additional string (4) at a force transfer point (6). Therein, according to the invention each bow (2) is pivoted at the bow holder rotatably about a rotation axis (5), so that in drawing the accelerating device (1) the bows (2) orientate to the actual force transfer point (6).

12 Claims, 7 Drawing Sheets

MECHANICAL ACCELERATING DEVICE FOR PROJECTILES

FIELD OF INVENTION

The invention relates to a mechanical accelerating device for projectiles, especially for arrows and bolts, the device having a bow holder, at least two elastic bows attached to the bow holder, each of the bows being engaged by a bow string, and at least one additional string connecting the bow strings, the force of the bows acting on the actual projectile by means of the additional string at a force transfer point.

BACKGROUND OF THE INVENTION

The term "mechanical accelerating device for projectiles" covers hand bows for accelerating arrows as well as cross-bows for accelerating arrows, bolts or balls as well as all other devices in which a projectile is accelerated with the aid of bows. Subdividing the projectiles by their length and their weight distribution into arrows, bolts and balls is of no importance for the present invention. Accordingly, in the following the term "arrow" or "arrows" which is often used alone includes all other projectiles.

A mechanical accelerating device as described at the beginning is known from German Patent 42 20 575. This accelerating device includes two bows with pre-tensioned bow strings, the string middles of which are connected to the two ends of an additional string. The bows are identical and have a fixed, i.e. rigid orientation with regard to the acceleration path of the projectiles which is covered by the force transfer point. The bows are arranged in a single plane both having an inclination of about 45 degree with regard to the acceleration path. In this way, the bows are oriented to the force transfer point at which the transfer of the pull force from the bows to the arrows takes place, when the accelerating device is fully drawn.

However, already after the arrows have been accelerated over a short distance, this orientation is no longer given, whereby in consequence the degree of effectiveness in transferring the energy stored in the bent bows to the arrow decreases with progressing acceleration path. Additionally, the bows are asymmetrically loaded, whereby their life is affected.

It is an object of the invention, to provide an accelerating device of the type described at the beginning which optimally makes use of the energy stored in each bow and in which, at the same time, each bow is subjected to as low strain as possible.

SUMMARY OF THE INVENTION

According to the invention this problem is solved, in that each bow is pivoted at the bow holder rotatably about a rotation axis, so that in drawing the accelerating device the bows orientate to the actual force transfer point, at which the transfer of the accelerating force to the projectile takes place. So, the transfer of the energy stored in all bent bows has an optimum degree of effectiveness over the whole acceleration path and loading the bows asymmetrically is absolutely impossible.

If the bows of the accelerating device are arranged in a single plane, the rotation axes of the bows have to be perpendicular to said plane for enabling the rotatability according to the invention. However, a more favourable dynamical behaviour of the bows is achieved if they are not arranged in a single plane but parallel to each other, wherein the planes of their main extension intersect in a straight line running through the force transfer point. In this case the rotation axes have to be arranged parallel to the straightened strings of the bows and within the planes of the main extension of the bows for enabling the rotatability according to the invention. The more favourable dynamical behaviour of the bows in this arrangement is based on the fact that the momentum of inertia of the bows in rotating about the rotation axes is smaller as in the arrangement with the bows in a single plane. Small momenta of inertia are especially obtained if the rotation axes run in front of the bow strings through an area limited by the bow strings and the bows.

The main axes of the inertia ellipsoid of the un-bent bows which have the smallest momentum of inertia are located in this area. The dynamic behaviour of the bows is optimal, if the rotation axes coincide with said main axes of the inertia ellipsoid. That the main axes of the inertia ellipsoid of the un-bent bows are relevant results from the fact that, when activating the accelerating device, the bows have their maximum angular velocity about the rotation axes at the same time as they are fully un-bent, whereas at the beginning of the acceleration process the bent bows only have low angular velocities about the rotation axes. Naturally, the bow-side parts of the attachment of the bows to the bow holder have also to be taken into consideration for determining the main axes of the inertia ellipsoid which, in an ideal case, coincide with the rotation axes.

Further, because of the coincidence of the rotation axes and the main axes of the inertia ellipsoid of the un-bent bows use is made of a pirouette effect in the necessary acceleration of the bows about their rotation axes. With regard to said rotation axes the bent bows have a greater momentum of inertia as the un-bent bows. So the momentum of momentum conservation has the effect that an already existing rotation of the bows is accelerated with regard to their angular velocity while the bows un-bend.

In the new accelerating device the single bows are preferably identical, wherein the rotation axes of the bows are arranged symmetrically with regard to the acceleration path of the arrows or bolts.

The symmetrical arrangement of the bows with regard to the acceleration path can be most easily realized with two bows. If there are three, four or more bows each pivoted rotatably about a rotating axis, the principle of the additional strings can be realized in an iterative way. In preferred embodiments thereof the bow strings are connected with each other by a total of three or four additional strings, wherein each bow string is engaged by two different additional strings and wherein said four additional strings are connected with each other by further additional strings crossing each other in the force transfer point. The pull force of the bows acts on the arrows at the force transfer point via the additional strings connecting the bow strings and via the further additional strings.

Blade bearings are especially suitable for pivoting the bows at the bow holder. The rotation area of the bows is typically 40 to 60 degree, which can be easily covered by blade bearings. At the same time a remarkable smooth running and sufficient force bearing capabilities are features of blade bearings.

The blade bearing can be of open construction and thus enable an easy disassembly of the accelerating device. To achieve this, the additional strings are pre-tensioned by the bows in the un-drawn accelerating device and the bows themselves are fixed in the blade bearings by the pre-tension. By applying higher pull forces to the bows than the pre-tension, the bows van be removed from the blade bearings.

While drawing the accelerating device the bows are fixed in the blade bearings by the resultant of the total draw force in each of the blade bearings.

If deflection sheaves, eccentric disks and/or cam wheels are to be used to change the force-displacement-curve of the accelerating device, they can be provided for the bow strings of the single bows. If the deflection sheaves, eccentric disks and/or cam wheels are allocated to the additional strings, wherein they are pivoted on the bow strings, their greater influence on the inertia mass of the accelerating device has to be taken into account. In this arrangement they have to be as lightweight as possible to not clearly decrease the degree of effectiveness of the accelerating device when accelerating particular lightweight arrows.

Advantageously, the bow holder has a shooting window, so that all loaded parts of the accelerating device can be arranged symmetrically with regard to the acceleration path of the projectiles.

The accelerating device can be realized as a hand bow, wherein the bow holder has a grip beneath the shooting window and wherein the additional string acting on the arrow is provided for being drawn by hand.

However, a realization as a crossbow is particularly advantageous, wherein the bow holder is attached to a stock and wherein a guideway is provided for the projectiles, the guideway being as closed all around as possible. The guideway being closed all around is recommended in the new accelerating device, because the new accelerating device allows such high acceleration of bolts and arrows that they are not sufficiently orientated by a guideway open to one side, whereby the danger of swerving occurs.

BRIEF DESCRIPTION OF THE DRAWINGS

In the following the invention is further explained and described by means of embodiments. Therein.

DETAILED DESCRIPTION

Figure 1:
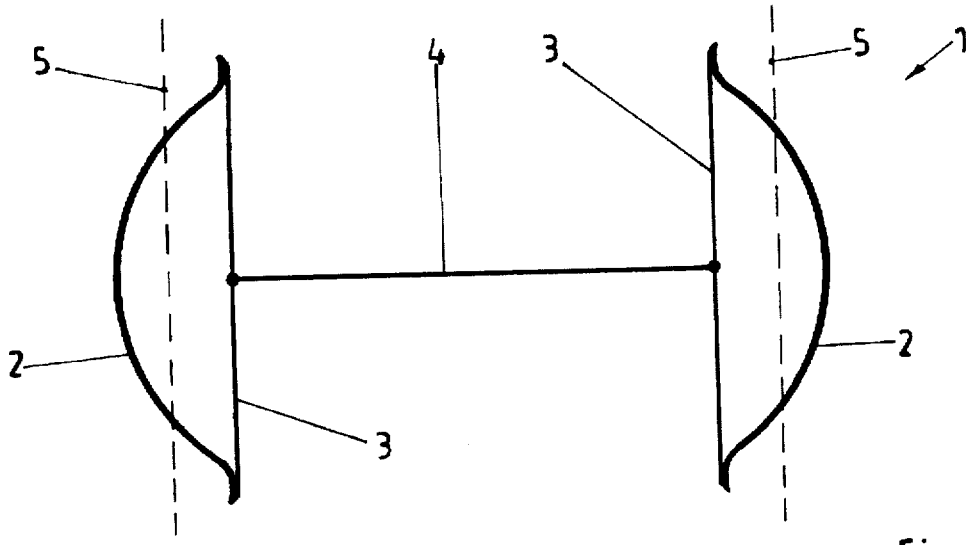
FIG. 1 is a side view of the schematic construction of a first embodiment of the device.

The accelerating device 1 according to FIG. 1 has two identical bows 2, each of the bows 2 being engaged by the ends of a bow string 3. The bows 2, i.e. their bow strings 3, are orientated parallel to each other. The middles of the two bow strings 3 are connected with each other by an additional string 4. Each of the two bows 2 is pivoted rotatably about a rotation axis 5 at a bow holder which is not depicted here. The rotation axes 5 run parallel to the bow strings 3 and approximately coincide with the main axis of the inertia ellipsoid of the un-bent bows which have the smallest momentum of inertia. In this context "un-bent bow" relates to the bows in case of the un-drawn accelerating device. In this case the bow strings are still pre-tensioned in their main extension direction. Preferably, the additional string 4 is also pre-tensioned for its tightening.

Figure 2:
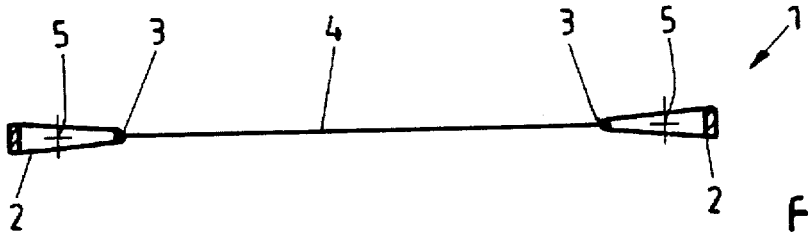
FIG. 2 is a cross section through the accelerating device according to FIG. 1 in an un-drawn state.
Figure 3:
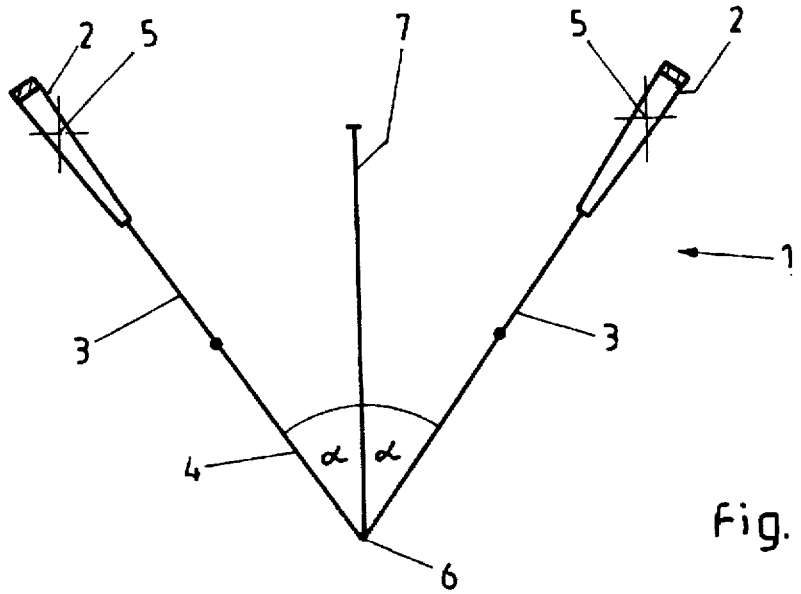
FIG. 3 is a cross section through the accelerating device according to FIG. 1 in a drawn state.

The un-drawn state of the accelerating device 1 is depicted in FIG. 2. In contrast, FIG. 3 shows the drawn accelerating device. It is apparent from the comparison of FIGS. 2 and 3, that the bows always orientate to a force transfer point 6 which is here the middle of the additional string 4. This orientation is enabled by the rotatability of the bows 2 about the rotation axes 5. The orientation of the bows 3 to the force transfer point 6 is given over the whole acceleration path 7, which is covered by the force transmission point 6 in accelerating a projectile with the accelerating device 1. So the energy which is transferable from the bows is transferred to the projectiles with the maximum degree of effectiveness in every point of the acceleration path 7.

The arrangement according to the FIGS. 1–3 enables a greater acceleration of an arrow having a predetermined mass $M_p$ than possible with, for example, two bows arranged over-and-under, i.e. parallel to each other. This can be understood from the following thoughts:

The energy which can be transferred by an acceleration device to an arrow or an other projectile is determined by the ratio of the mass of the arrow or bolt $M_p$ and a so-called virtual mass $M_v$ of the accelerating device. The virtual mass $M_v$ takes into account the means of the inertia masses M of the accelerating device effective at the actual force transfer point and weighted by the force in acceleration direction over the acceleration path 7. In this, it is defined that the accelerating device accelerates its virtual mass $M_v$ up to a velocity V, if it accelerates an arrow up to this velocity V. After the acceleration process, the energy E which can be transferred by the accelerating device is divided up in a kinetic energy of the arrow $$E_r = \tfrac{1}{2} M_p V^2$$

and a kinetic energy of the virtual mass $$E_v = \tfrac{1}{2} M_v V^2.$$

From this, the kinetic energy $E_p$ apportioned to the arrow is derived as $$E_p = E(M_p/(M_p+M_v)).$$

I.e., the degree of effectiveness $M_p/(M_p+M_v)$ increases with the mass $M_p$ of the arrow.

This means at the same time that the degree of effectiveness decreases with increasing velocities of the arrows as higher velocities can only be achieved with lighter arrows.

In case of two bows simply arranged parallel to each other, i.e. over-and-under, the total virtual mass $M_v$ is twice as high as the virtual mass $M_v$ of each single bow. As a result, the same degree of effectiveness as compared with the single bows can only be reached with an arrow twice as heavy.

The arrangement according to the FIGS. 1–3 is different. There, it results from considering an angle $\alpha$ between the bows 2 oriented to the force transfer point 6 and the acceleration path 7, that the total pull force F can be calculated from the pull forces of the two bows f according to $$F=2 f \cos \alpha.$$

At the same time, it results from the geometrical conditions that the acceleration A at the force transfer point 6 is connected with the acceleration a at the connection points of the additional string 4 to the bow strings 3 according to $$A=a/\cos \alpha.$$

If the two equations mentioned at least are placed in the formulation $$F=M\times A,$$

M, i.e. the effect of the inertia masses m of both bows 2 at the force transfer point 6, is obtained as:

$$M=2 m \cos^2 \alpha.$$

Since $\alpha$ is smaller than 90 degree over the whole acceleration path $\cos^2 \alpha$ is always smaller than 1, which results in that the force weighted mean of M, i.e. the virtual mass $M_v$, is smaller than two times the virtual mass $m_v$ of the single bows. In this calculation the effects of the inertia moments of the bows when rotating about the rotation axes 5, and the inertia mass of the additional strings have not been taken into account. However, this calculation is just for explaining that it is, in principle, possible to obtain a virtual mass in combining two bows which is smaller than the sum of both individual virtual masses. In practice, an arrow which has three times the virtual mass of the accelerating device 1 and which therefore takes up 75% of the total energy E of the accelerating device reaches a clearly higher velocity in case of the new accelerating device than in the comparative case of two bows arranged over-and-under in which a corresponding taking up of energy is only possible at the same velocity as in the case of single bows.

It is a further advantage of the accelerating device according to FIGS. 1–3 that the bounce kick in un-bending of the single bows is compensated because the bows are arranged symmetrically with regard to the acceleration path, and that the stop shock of the additional string 4 is negligible because at the end of the acceleration path only the momentum of the bow springs 3 having comparable low inertia masses acts on the additional string 4. Normally, the stop shock is a remarkable higher strain on a bow string than the resultant of the occurring pull forces, the stop shock is based on the opposed momenta of the limbs of the bow which have to be absorbed by the straightened bow string when reaching its limit of elasticity.

Besides, the energy absorbtion of the bows 2 by their rotation movement about the rotation axes is comparably low. This is derived from their moment of inertia about the rotation axes 5 decreases with the progress in un-bending by means of the limbs of the bows straightening up, whereby a self acceleration in rotation direction of the bows 2 occurs because of the momentum of momentum conservation.

Figure 4:
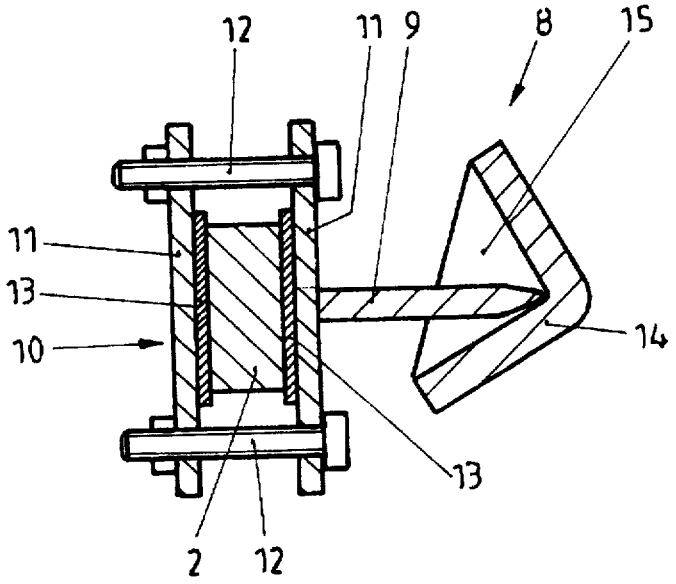
FIG. 4 shows a first embodiment of a blade bearing for a bow of the accelerating device.
Figure 8:
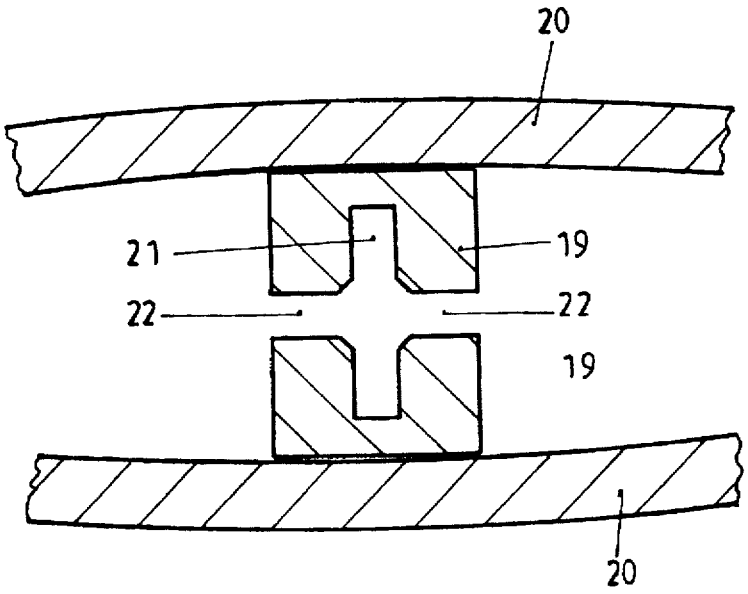
FIG. 8 shows a detail of the crossbow according to FIG. 7.

An embodiment of the bearing for one of the bows 2 according to FIGS. 1–3 is depicted in FIG. 4. It is a blade bearing 8, the blade 9 of which is attached to the bow 2 by means of holding means 10. The holding means 10 comprises of two clamping jaws 11 between which the bow 2 is clamped with the aid of screws 12. Elastic absorption elements which are, for example, made of an elastomer material are arranged between the clamping jaws 11 and the bow 2. The elastic absorbtion elements 13 serve for not directly transmitting vibrations of the bow to the blade bearing 8. On the bow holder side the blade bearing 8 has a bearing shell 14 which allows to rotate the blade 9 for 50–60 degree. For fixing the height of the blade 9 the bearing shell 14 comprises a web 15 which engages in a corresponding recess in the blade 9. The blade bearing according to FIG. 8 also enables an easy disassembly of the accelerating device, wherein, in the un-drawn state of the accelerating device, the bows can be removed from the blade bearings 8 to the side against their pull force.

Figure 5:
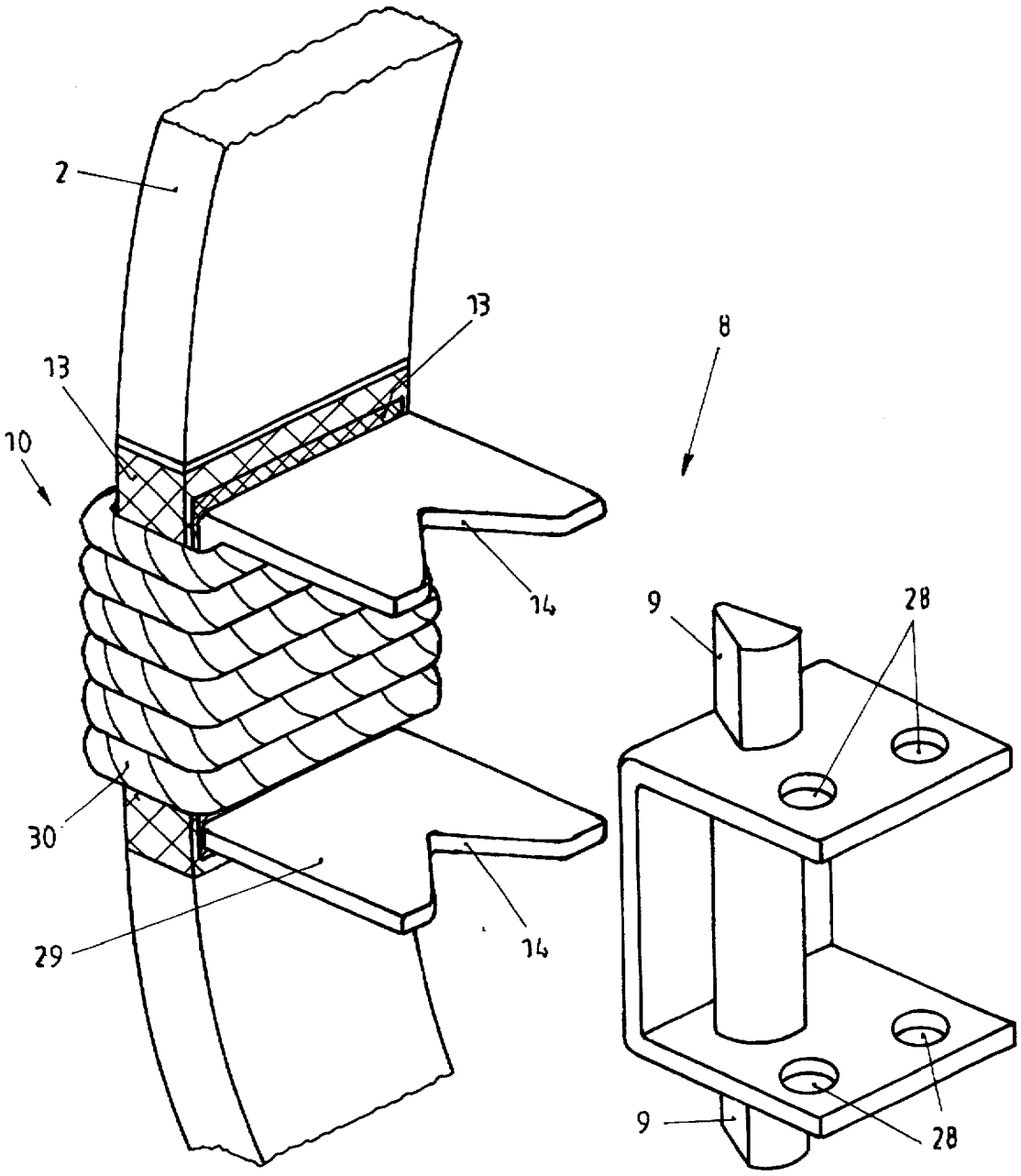
FIG. 5 shows a second embodiment of a blade bearing for a bow of the accelerating device.

The blade bearing according to FIG. 4 has a relative high weight, whereby the effective momenta of inertia of the bows 2 about the rotation axes 5 are relative high. Further, the quasi-rigid support of the bows 2 between the clamping jaws 11 is disadvantageous because of the deformation of the bows even in this area. A blade bearing 8 of very simple construction and a holding means 10 which do not have these disadvantages are shown in FIG. 5. Here, the blade 9 is formed by a round rod filed to dimensions which extends through an U-shaped support bracket 27 and which is welded together with the support bracket. The support bracket 27 has fixation holes 28 for fixation to the bow holder. The bearing shells 14 which are here allocated to the bow 2 are provided at the free ends of an U-shaped bracket element 29 which encompasses the support bracket 27 in the assembled state of the accelerating device. At the same time, the bracket element is a part of the holding means 10 for the bow 2. Therein, a binding 30 is tightly wound around the middle part of the bracket element 29 and the bow 2. The absorption elements 13 are provided within the binding 30. The absorbtion elements are an adhesive textile tape wound around the bow 2 and a hard rubber plate between the bow 2 and the middle part of the bracket element 29. The bearing of bows by means of a winding is well-established in the construction of crossbows for centuries. The winding provides a sufficiently stable bearing of the bow and a shock absorbing effect at the same time.

Figure 6:
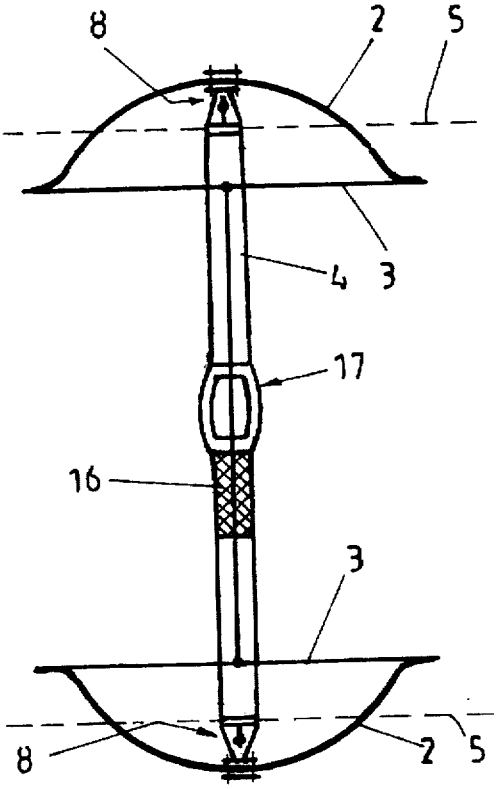
FIG 6 shows a concrete embodiment of the accelerating device formed as a hand bow.

FIG. 6 shows a concrete embodiment of the accelerating device as a hand bow. Herein, the bow holder 20 has a grip 16 and a shooting window 17. Typically of a hand bow, the shooting window 17 is not provided in the middle of the bow holder but a little eccentrically above the grip 16. An arrow support and a bow sight, which are however not depicted here, may be provided within the shooting window which is here limited to all sides.

Figure 7:
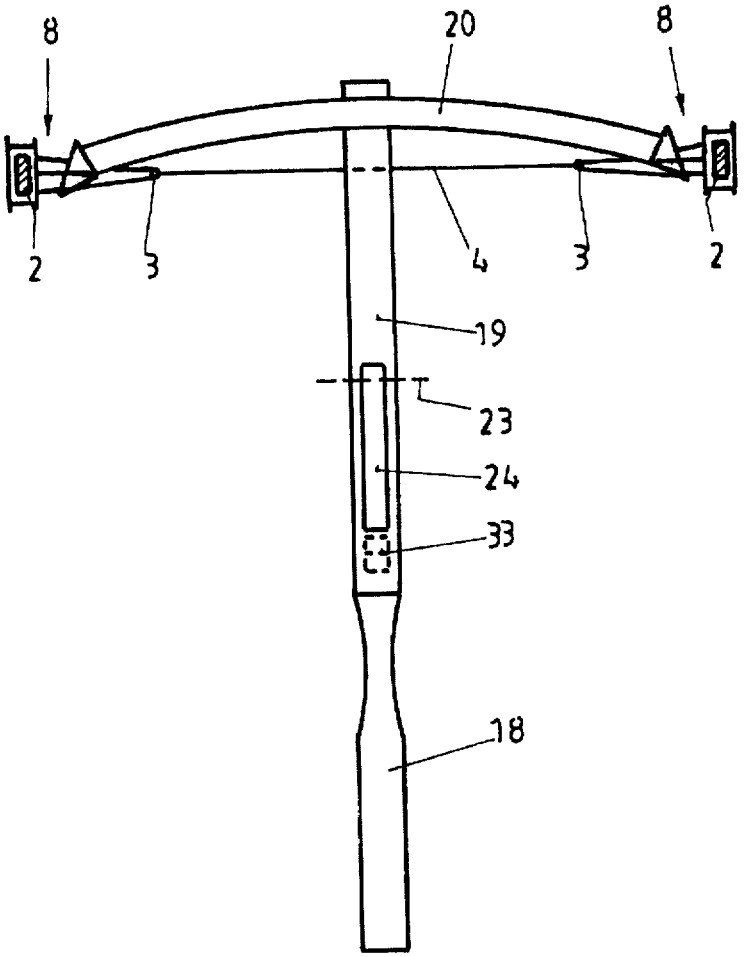
FIG. 7 shows a further concrete embodiment of the accelerating device formed as a crossbow.

A further embodiment of the accelerating device is apparent from FIG. 7. Here, the accelerating device is realized as a crossbow, wherein the bow holder 20 is supported by a stock 18 and a guideway 19 is provided which is closed all around the arrows or bolts to be accelerated. According to FIG. 7, the all around closed guideway extends through two symmetrically formed support limbs of the bow holder 20, the blade bearings being provided at the end of said support limbs. Therefore, the bows 2 with their bow strings 3 and the additional string 4 are arranged totally symmetrically with regard to the guideway 19. The guideway 19 guides the arrows or bolts all around, wherein the guideway 19 has recesses 21 for receiving stabilizing feathers of the arrows. Openings 22 are necessary so that the additional string 4 reaches the arrow within the guideway 19. A loading trap door 24 swivelling about a swivel axis 23 is provided for inserting the arrow or bolt into the guideway 19. A nut for holding the drawn additional string 4 is provided behind the loading trap door, the nut being releasable by means of a trigger. The support limbs of the bow holder 20 are shaped in such a way that dashing of the bow strings 3 against the bow holder 20 is prevented. So the bow holder also has bow shape but it is not elastic.

Figure 9:
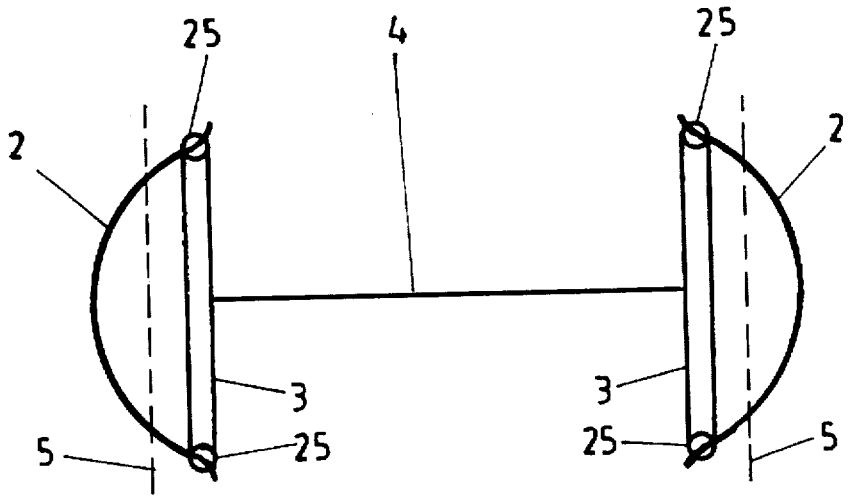
FIG. 9 shows an embodiment of the accelerating device having deflection sheaves for the bow strings of the single bows.

FIG. 9 shows an improvement of the accelerating device according to FIGS. 1–3. Therein, the bows comprise deflection sheaves 25. The bow strings 3 are running around this deflection sheaves in an endless loop. So, a so-called compound-system is easily realized. The deflection sheaves may also be constructed as cam wheels or eccentric disks. Therein, it is not necessary that the bow strings 3 are always closed. In any case the deflection sheaves 25 are for alternating the effective force-displacement-curves of the bows 2 when drawing the bow strings 3.

Figure 10:
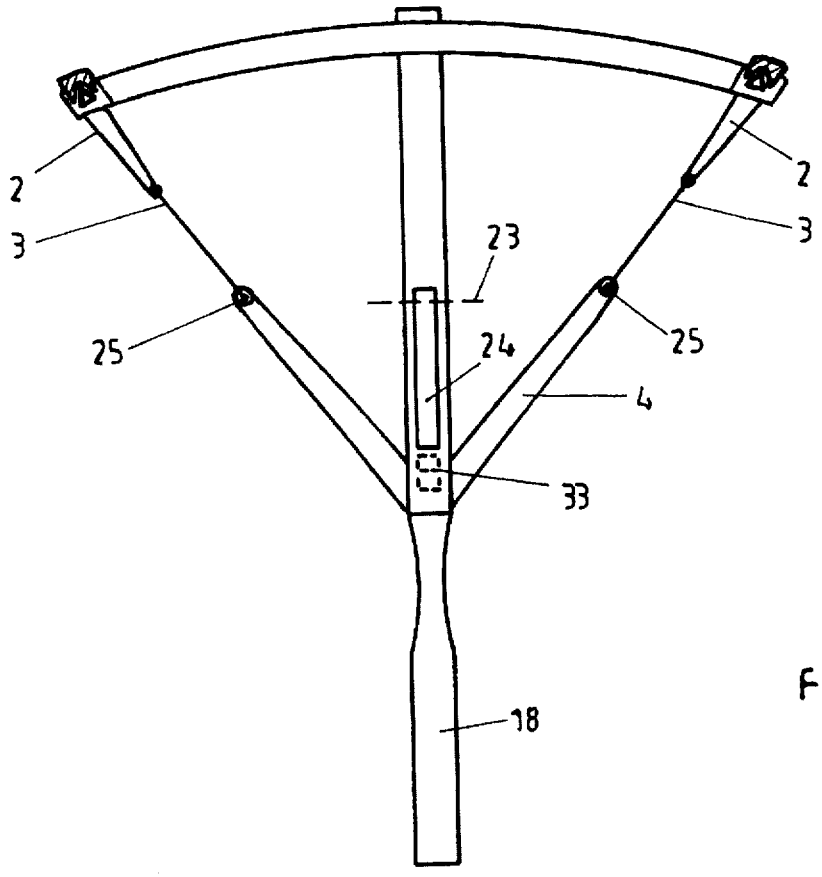
FIG. 10 shows a further embodiment of the accelerating device having deflection sheaves for an additional string as an improvement of the crossbow according to FIG. 7.

In contrast to FIG. 9, the deflection sheaves 25 of the accelerating 1 device according to FIG. 10 which is constructed as a crossbow are not provided on the bows 2 but on the bow strings 3, wherein the additional string 4 runs around the deflection sheaves. It is a further difference over FIG. 9 that the additional string 4 is not closed but affixed to the stock 18 with its free ends. The deflection sheaves 25 for the additional string 4 are of an extreme lightweight construction to not too overmuch increase the virtual mass of the accelerating device 1 because their masses greater affect the virtual mass as the masses of the deflection sheaves 25 for the bow strings according to FIG. 9. As a result an alternation of the force-displacement-curve of the accelerating device 1 in drawing is also obtained by the deflection sheaves 25 according to FIG. 10. It is remarkable that in the accelerating device according to FIG. 10 the bows 2 are not orientated to the force transfer point 6 with their symmetry axes because of the deflection sheaves for the additional string 4. Instead, the symmetry axes are crossing behind the force transmission point 6, but in front of the fixation points of the additional string to the stock 18. However, the remaining orientation of the bows to the actual force transfer point 6 is sufficient for the solution of the problem of the invention.

Figure 12:
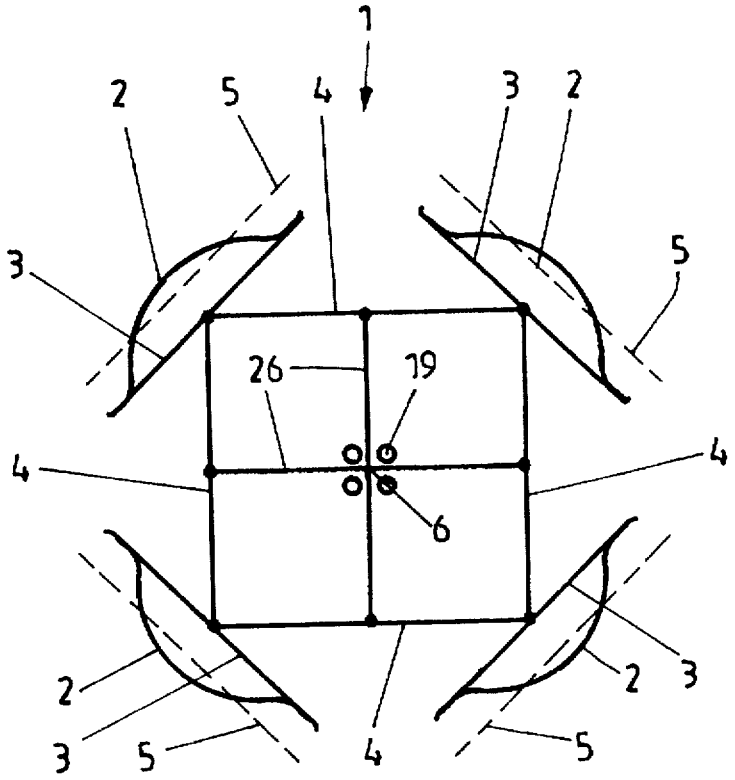
FIG. 12 shows an embodiment of the accelerating device having four pivoted bows.
Figure 11:
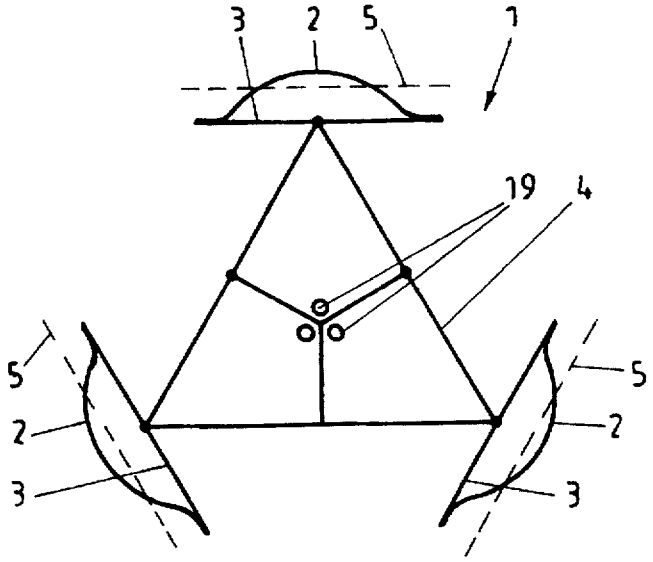
FIG. 11 shows an embodiment of the accelerating device having three pivoted bows.

Further improvements of the accelerating device according to FIGS. 1–3 are sketched in FIGS. 11 and 12. Here, a total of three and four bows 2 are provided, each of the bows rotating about a rotation axis 5. The bows 2 are rotationally symmetrically arranged around the acceleration path which runs within the guideway 19, i.e. perpendicular to the drawing plane through the force transfer point 6. Each of the bow strings 3 is engaged by two additional strings 4. The middles of the additional strings 4 are connected with each other by further additional strings 26 which are crossing within the guideway 19 in the force transfer point 6. In this way, the reduction of the virtual masses of the single bows 2 is carried out in two steps, i.e. at first by means of the additional strings 4 and at second by means of the further additional strings 16. This principle can not be successfully carried on and on because the additional mass of further additional strings increasingly affects the virtual mass of the total accelerating device. In the accelerating devices according to FIGS. 11 and 12 also, all of the bows orientate to the actual force transfer point 6 so that use is made of the energies stored in all of the bows with the maximum degree of effectiveness.

Figure 13:
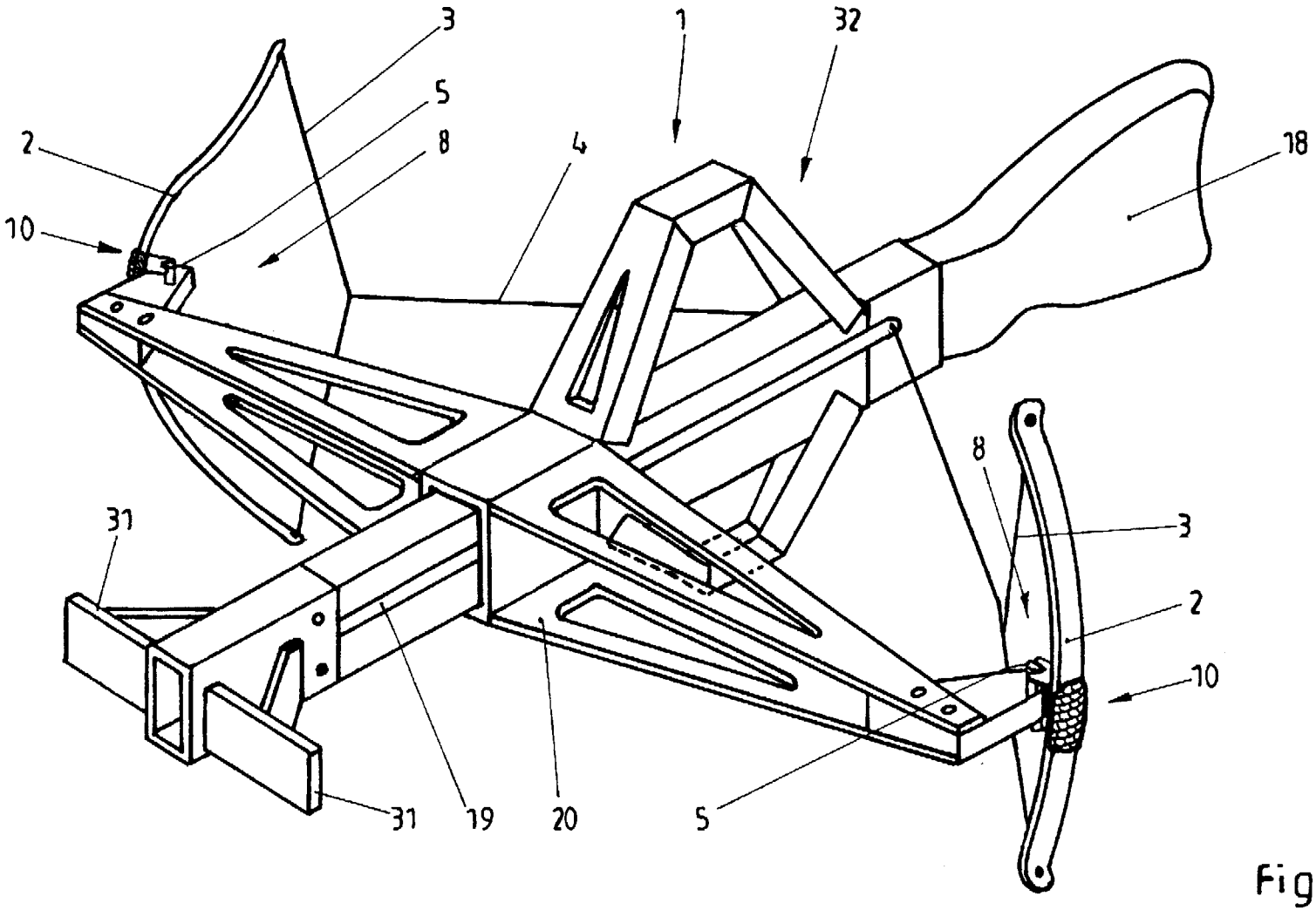
FIG. 13 shows a further improvement of the embodiment of the accelerating device formed as a crossbow.

FIG. 13 shows an accelerating device 1 which is improved over the embodiment as the crossbow according to FIG. 7 with regard to means for drawing the acceleration device. At first, these means are protrusions 31 laterally extending from the foremost part of the guideway 19, by means of which the crossbow can be held back with the feet in drawing the additional string 4. At second, the bow holder 20 is mounted to the stock 18 slidably along the guideway 19. This enables drawing the additional string 4 behind the nut which is invisible here with a relative low effort in force, while the bow holder is in its backward position. Afterwards, the bow holder 20 is brought in its forward position with the aid of knee lever arrangement 32, whereby the accelerating device 1 is completely drawn. In the forward position of the bow holder the knee lever arrangement 32 supports the total resulting pull force of the accelerating device 1, whereby the guideway 19 remains force-free so that the shooting precision is enhanced. For actuating the knee lever arrangement 19 which is arranged symmetrically with regard to the guideway 19 a handling winch or something like that may be provided.

LIST OF REFERENCE SIGNS

1—accelerating device
2—bow
3—bow string
4—additional string
5—rotation axis
6—force transfer point
7—acceleration path
8—blade bearing
9—blade
10—holding means
11—clamping jaw
12—screw
13—absorption element
14—bearing shell
15—web
16—grip
17—shooting window
18—stock
19—guideway
20—bow holder
21—recess
22—opening
23—swivel axis
24—loading trap door
25—deflection sheave
26—additional string
27—support bracket
28—fixation hole
29—bracket element
30—binding
31—protrusion
32—knee lever arrangement
33—nut

I claim:

1. A mechanical accelerating device for projectiles, especially for arrows and bolts, the device having a bow holder, at least two elastic bows attached to the bow holder, each of the bows being engaged by a bow string, and at least one additional string connecting the bow strings, the force of the bows acting on the actual projectile by the additional string at a force transfer point, wherein each bow is pivoted at the bow holder rotatably about a rotation axis, so that in drawing the accelerating device the bows orientate to the actual force transfer point.

2. An accelerating device according to claim 1, wherein the rotation axes are arranged parallel to the straightened bow strings of the bows.

3. An accelerating device according to claim 2, wherein the rotation axes extend within the planes of the main extensions of the bows.

4. An accelerating device according to claim 3, wherein each bow includes an inertia ellipsoid with a main axes extending through the bow, and the rotation axes of the bows coincide with the main axes of the inertia ellipsoid of the bows of the un-drawn accelerating device which have the smallest momentum of inertia.

5. An accelerating device according to claim 1, wherein the bows are identical, and wherein the rotation axes of the bows are arranged symmetrically with regard to the acceleration path of the arrows or bolts.

6. An accelerating device according to claim 1, wherein a total of at least three bows each rotating about one rotation axis is provided, wherein the bow strings of the bows being connected with each other by a total of at least three additional strings, and wherein each bow string is engaged by two different additional strings and wherein said at least three additional strings are connected with each other by further additional strings crossing each other in the force transfer point.

7. An accelerating device according to claim 1, wherein a blade bearing is provided for supporting each bow on the bow holder.

8. An accelerating device according to claim 7, wherein each of the additional strings is under pre-tension in the un-drawn accelerating device, and wherein the bows are held in the blade bearings by this pre-tension.

9. An accelerating device according to claim 1, wherein the bows comprise deflection sheaves, eccentric disks and/or cam wheels about which the bow strings run in drawing.

10. An accelerating device according to claim 1, wherein deflection sheaves, eccentric disks and/or cam wheels are provided between the bow strings and each additional string about which each additional string run in drawing.

11. An accelerating device according to claim 1, wherein the bow holder has a shooting window.

12. An accelerating device according to claim 1, wherein the accelerating device is constructed as a crossbow, wherein the bow holder is attached to a stock and wherein a guideway is provided for the projectiles, the guideway being closed all around.

* * * * *